United States Patent [19]

Arduini et al.

[11] Patent Number: 4,777,985

[45] Date of Patent: Oct. 18, 1988

[54] CAP FOR PROTECTING PIPE ENDS, AND A CUTOUT BLANK FOR MAKING THE CAP

[75] Inventors: Serge A. Arduini, Heillecourt; Jean-Michel Hinzelin, Nancy, both of France

[73] Assignee: Papeteries et Cartonneries de Lorraine, France

[21] Appl. No.: 87,680

[22] PCT Filed: Dec. 5, 1986

[86] PCT No.: PCT/FR86/00423

§ 371 Date: Jul. 23, 1987

§ 102(e) Date: Jul. 23, 1987

[87] PCT Pub. No.: WO87/03562

PCT Pub. Date: Jun. 18, 1987

[30] Foreign Application Priority Data

Dec. 6, 1985 [FR] France ..... 85 18104

[51] Int. Cl.[4] ..... F16L 57/00

[52] U.S. Cl. ..... 138/96 R

[58] Field of Search ..... 138/89, 96 R, 96 T, 138/98, 109; 229/4.5, 5.5, 5.6, 108, 109, 110, 176; 428/36

[56] References Cited

U.S. PATENT DOCUMENTS

| | | | |
|---|---|---|---|
| 440,168 | 11/1890 | Kurtz | 138/96 R |
| 1,498,563 | 6/1924 | Morrison et al. | 138/96 R |
| 2,708,453 | 5/1955 | Das | 138/96 R |
| 2,828,904 | 4/1958 | Mires et al. | 229/110 |
| 3,018,883 | 1/1962 | Wohlforth | 206/396 |
| 3,314,586 | 4/1967 | Frank | 206/303 |
| 4,630,646 | 12/1986 | Koehle | 138/96 R |

FOREIGN PATENT DOCUMENTS

| | | | |
|---|---|---|---|
| 856245 | 6/1940 | France . | |
| 2084705 | 12/1971 | France . | |
| 2208378 | 6/1974 | France . | |
| 2344451 | 10/1977 | France . | |
| 220072 | 8/1924 | United Kingdom . | |
| 537287 | 6/1941 | United Kingdom . | |
| 621696 | 4/1949 | United Kingdom | 229/108 |
| 887475 | 1/1962 | United Kingdom . | |

*Primary Examiner*—Mark J. Thronson

*Attorney, Agent, or Firm*—Griffin, Branigan & Butler

[57] ABSTRACT

The blank has a rectangular body (1) which becomes the skirt of the cap when in use, with complementary fastening means (2, 3), a first fold groove (7) along one edge followed by a strip (5), a further fold groove (8) and a plurality of tongues (6), cutout slots (9) running from the first fold groove (7) to give each tongue (6) an edge which terminates in a truncated point (11A) which fastens in the in-use position to the adjacent edge of the adjacent tongue in order to protect the inside face of a pipe.

4 Claims, 1 Drawing Sheet

CAP FOR PROTECTING PIPE ENDS, AND A CUTOUT BLANK FOR MAKING THE CAP

The invention relates to a cap intended to be placed over the ends of pipes and of similar tubular bodies, and particularly but not exclusively of cast iron pipes, for the purpose of protecting said ends during handling and transport of such bodies.

Caps of protective end fittings are already known for pipes or for similar articles, they are made of card or composite material comprising superposed layers of card and plastic material.

For example, British patent specification GB-A-537 287 describes a protective wrapping for coils of electric wires, which wrapping includes a central strip intended to be closed over the outer cylindrical face of a coil of electric wires. Trapezium-shaped tongues extend away from both longitudinal edges of said central strip and taper away from the central strip. These tongues are intended to be folded down over a respective one of the plane side faces and over the inside cylindrical face of the coil. Tongues from opposite sides overlap one another on the inside cylindrical face and they are provided with a layer of adhesive over their end portions in order to ensure that they remain in this position.

French patent specification FR-A-856 245 describes a similar wrapping for the same purpose but in which the tongues are rectangular in shape and the central strip has transverse fold lines extending the notches between the tongues. In use, the closed central strip is in the form of successive plane faces; the tongues are folded down only over the plane side faces of the coil of wires and they overlap one another partially. A sheet of paper or card is glued over the folded down tongues in order to hold them in position.

Caps made in accordance with these documents are not suitable for protecting the end portions of pipes.

French patent specification FR-A-2 208 378 describes a pipe-end-protecting cap having a cylindrical skirt for protecting the outer side face of the pipe, an inwardly directed flange for protecting the end of the pipe, and inwardly sloping lips for protecting the inner face of the pipe. However, the free end portions of these inclined lips are separated by cutout slots.

Caps made in accordance with this design do not have a protective portion which properly covers the inner face of the pipe; each such cap is suitable only for a single size of pipe or for a narrow range of pipe sizes, and such caps occupy considerably volume.

The main aim of the invention is to provide a cap or protective end fitting for the ends of tubular bodies, in particular pipes, where the inner faces of such bodies are properly covered, at all times, by a protective layer. A secondary aim of the invention is to provide a cap capable of being stored flat and suitable for tubular bodies of very different sizes, while ensuring proper protection of the outer surface, of the end surface, and of the inner surface of the end portions of tubular bodies under all circumstances.

Another aim of the invention is to provide a cap of the above-defined type in which the folded down tongues remain in place without using an adhesive.

The invention also relates to a flat cutout blank for obtaining such a cap.

In a protective cap comprising s skirt terminated on a side edge by a fold groove, a strip folded through 90° towards the inside of said skirt and connected to said side edge, tongues folded into a position parallel with said skirt and inside said skirt, connected at one end to said strip and separated from one another by cutout slots, according to the invention the cutout slots extend across said strip dividing it into lengths of strip and reach the fold groove running along the skirt, and said cutout slots extend, at least at their end portions close to the free edges of the tongues, in a general direction which is at an angle relative to said free edge, thus giving rise to a point on one of the sides of each tongue.

Thus, when in use, each point engages the adjacent edge of the adjacent tongue.

Preferably, each cutout slot follows a curved line having a convex edge on one tongue and a concave edge on the adjacent tongue, said concave edge being the edge from which there projects a point.

Also preferably, each cutout slot follows a curved line at least from said strip towards said free edges of the tongues and, over a short distance prior to reaching said free edges, follows a straight line which is substantially perpendicular to said free edges, giving rise to a heel on the convex edge and to a truncated point on the concave edge.

There follows a description of a preferred implementing of the invention. Reference is made to the accompanying drawing, in which.

Figure 1:
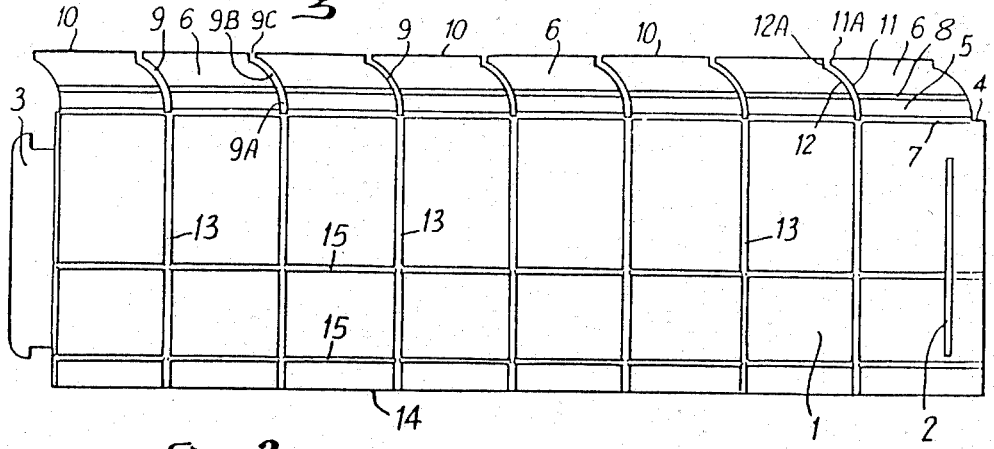
FIG. 1 is a plan view of a cutout blank suitable for making a cap in accordance with the invention.

The cutout blank shown in FIG. 1 comprises a rectangular body 1 which is to become the skirt 1′ (FIG. 2) of the cap after said body has been looped back on itself. A slot 2 is cut out at one longitudinal end of the body 1 and a lug 3 is provided at the opposite end of the body with the tip of the lug being longer than the slot 2 so as to enable the lug to be engaged slantingly in the slot and then be retained therein. Other complementary fastening means could be used.

The body 1 of the blank which becomes the skirt 1′, has a side edge 4 designated on the cap by reference 4′, which edge is connected to a strip 5, beyond which there are tongues 6.

A first fold groove 7 is provided between the body 1 and the strip 5; a second fold groove 8 is provided between the strip 5 and the tongues 6. In addition, the tongues 6 are separated from one another by cutout slots 9 which extend across the strip 5 up to the first fold groove 7 which extends between said strip and the body 1. As a result, the strip 5 is discontinuous, being split up into successive lengths, each of which is provided with a tongue 6.

Each of the cutout slots 9 comprises, going from the fold groove 7: a first portion 9*a* which intersects the strip 5 transversely to the longitudinal direction thereof; a curved second portion 9*b* extending over substantially all of the length of each tongue 6; and a third portion 9*c* which is perpendicular or substantially perpendicular to the free edges 10 of the tongues 6. Cutout slots 9 having this shape cause each tongue 6 to have a concave edge 11 and cause the immediately adjacent tongue 6 to have a convex edge 12. The convex edge 12 does not extend right up to the free edge 10 of the tongue; it is terminated by a short rectilinear edge 12*a* analogous to a heel extending perpendicularly to the free edge 10. Similarly, each concave edge 11 which would give rise to a point in conjunction with the free edge 10 if it were to reach said free edge is interrupted, before reaching the free edge, by a short rectilinear edge extending perpendicularly to the free edge 10. As a result a truncated point 11A is obtained.

A fold groove 13 extends transversely from the body 1 from each cutout slot 9 up to the opposite free edge 14 thereof. Each of these fold grooves 13 is accompanied by a reinforcing rib, in conventional manner. Preferably, two longitudinal reinforcing ribs 15 are also provided in the lengthwise direction of the body 1.

The cutout blank of FIG. 1 is easily looped on itself and it remains closed by virtue of the fastening means 2, 3. A second blank may be fastened to a first blank by engaging the lug 3 of one of the blanks into the slot 2 of the other blank and then by looping the assembly on itself by engaging the complementary fastening means at its opposite ends. A cap in accordance with the invention can thus be adapted to pipes of larger diameters, as required, by interconnecting a plurality of blanks one after the other.

Figure 2:
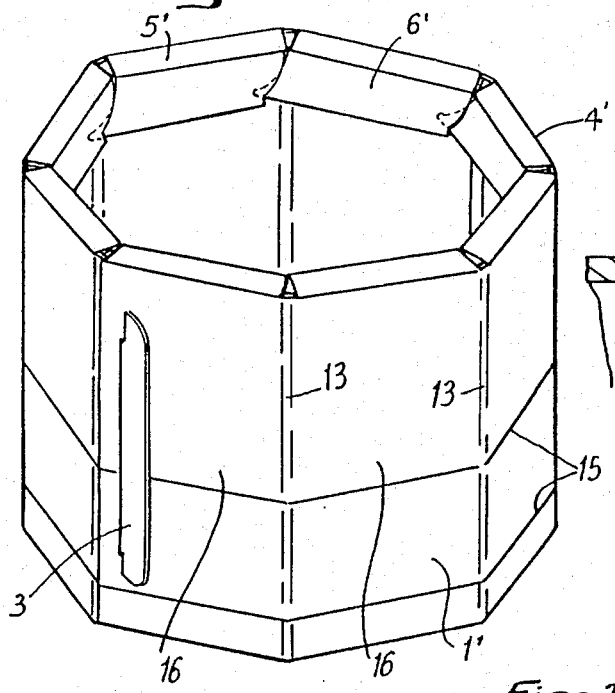
FIG. 2 is a perspective view from above of a cap obtained from the FIG. 1 blank.
Figure 4:
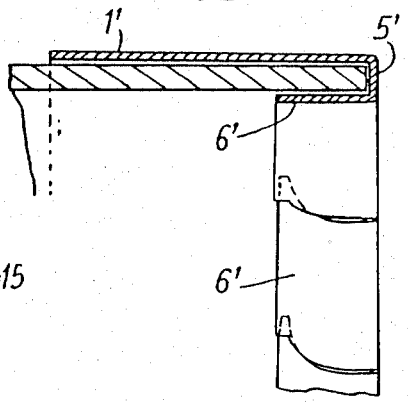
FIG. 4 is a fragmentary longitudinal section view showing how a pipe is protected by the cap of FIGS. 1 to 3.
Figure 3:
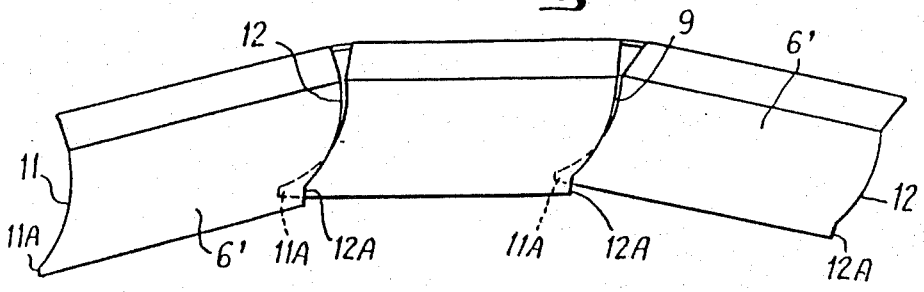
FIG. 3 is a detail view showing the tongues folded inwardly and coming into mutual engagement.

When one or more successive blanks are looped, the resulting configuration would be cylindrical were it not for the transverse fold grooves 13. When such grooves are present, a prismatic body is obtained whose side wall is constituted by successive facets 16 each having a length of strip 5 and a tongue 6 at one end. Thus, when the skirt 1' obtained in this way surrounds the outer face of a pipe, it is easy (as shown in FIGS. 2 and 4) to fold down each portion of strip 5 together with its tongue 6 through 90° towards the inside of the pipe and to fold down each tongue 6 through a further 90° into the pipe in order to obtain a wall 5' which protects the end face of the pipe and an inner wall 6' which is very close to the inner face of the pipe and which protects it. The tongues 6' are then substantially parallel to the skirt 1'. These folded down tongues 6 remain in the protective position because the truncated point 11A at the end of the concave edge 11 of each folded down tongue 6' is engaged beneath the heel 12A which terminates the convex edge 12 of the immediately adjacent folded down tongue 6'. This engagement of the successively folded down tongues 6' is made possible by virtue of the fact that the skirt 1' is looped back on itself and by virtue of then folding down taking place inwardly, i.e. around a perimeter which is shorter. Apart from the mutually engaged portions 11A and 12A, the concave edges 11 and the convex edges 12 between tongues and between lengths of folded down strip 5 come practically into contact with each other. The end face and the inside face of the pipe (which is often covered with a thin layer which is mechanically fragile) are properly protected by a protective wall which is very close thereto and which remains permanently in its protective position until the cap is removed from the pipe.

A cap in accordance with the invention can be made from card or from any material having desirably protective properties, such as plastic material or composite material. To this end, the fold grooves 13 which are not required with a flexible material make it possible to use a fairly rigid material which is looped in a series of facets 16. Naturally, a cap in accordance with the invention can be made from injected plastic material and may include different known means replacing the lug 3 for holding it looped to itself. In the above described example, each lug 3 could be inserted into its slot 2 from the outside and extend inwardly and then be folded back against the inside face of the skirt in order to provide improved locking.

We claim:

1. In a protective cap for the ends of tubular bodies, wherein the cap has two side edges and a skirt terminates at one of the said side edges by a fold groove, a strip folded through 90° towards the inside of said skirt and being connected to said one side edge, a plurality of tongues each having a free end edge and an end connected to said strip and said tongues being folded in an in-use position to extend parallel to and inside the said skirt, and said tongues being separated from one another by a plurality of cutout slots, the improvement comprising each said cutout slot extends across the said strip to said folded groove, and each said cutout slot extends along a line which is curved relative to the free end edge of each tongue, thereby giving rise to a concave edge portion on one tongue and a convex edge portion on the immediately adjacent tongue, but wherein said line ceases to be curved shortly before reaching said free end edge of the tongue and terminates in a straight line extending substantially perpendicularly to said free end edge, thereby giving rise to a heel on the convex edge portion and to truncated point on the concave edge portion, each truncated point of a tongue being engageable beneath the heel of the adjacent tongue when the cap is in its in-use position.

2. A cap according to claim 1, wherein there are further fold grooves which extend transversely to the skirt away from each cutout slot, thereby defining a plurality of facets in the cap when in its in-use position.

3. A cap according to claim 1, wherein complementary fastening means are provided on the skirt to hold said skirt in an in-use position about a tubular body and to hold together an assembly of two or more skirts, end-to-end, in an in-use position about a tubular body.

4. A cap according to claim 3, wherein the complementary fastening means comprise firstly a slot, and secondly a lug having a tip which is longer than the slot but which is capable of being engaged therein at an angle.

* * * * *